US012521622B2

(12) United States Patent
Schmider

(10) Patent No.: US 12,521,622 B2
(45) Date of Patent: Jan. 13, 2026

(54) SIMULATED BASKETBALL GAME SYSTEM

(71) Applicant: Richard A. Schmider, Pittsburgh, PA (US)

(72) Inventor: Richard A. Schmider, Pittsburgh, PA (US)

( * ) Notice: Subject to any disclaimer, the term of this patent is extended or adjusted under 35 U.S.C. 154(b) by 517 days.

(21) Appl. No.: 18/091,068

(22) Filed: Dec. 29, 2022

(65) Prior Publication Data

US 2024/0216789 A1 Jul. 4, 2024

(51) Int. Cl.

| | |
|---|---|
| ***A63F 3/00*** | (2006.01) |
| ***A63F 7/00*** | (2006.01) |
| ***A63F 7/06*** | (2006.01) |
| *A63F 7/40* | (2006.01) |

(52) U.S. Cl.

CPC ..... *A63F 7/0612* (2013.01); *A63F 3/00047* (2013.01); *A63F 2007/4031* (2013.01); *A63F 2250/42* (2013.01)

(58) Field of Classification Search

CPC ..... A63F 7/0612; A63F 2007/4031; A63F 2250/42; A63F 3/00028; A63F 3/00047

USPC ..... 273/317.3

See application file for complete search history.

(56) References Cited

U.S. PATENT DOCUMENTS 2,783,754 A * 3/1957 Heiss ..... A63F 7/0612 273/357
2,893,734 A * 7/1959 Tarte, Jr. ..... G07F 17/38 D21/305
3,119,620 A 1/1964 Peterson
3,350,097 A * 10/1967 Chevrette ..... A63B 63/08 273/350
3,586,323 A * 6/1971 Carter ..... A63B 67/007 273/440
3,599,978 A * 8/1971 Sondergaard ..... A63B 69/40 273/342
3,811,674 A * 5/1974 Trbovich ..... A63F 7/0612 273/357
3,899,173 A 8/1975 Zaris
4,013,292 A * 3/1977 Cohen ..... A63B 69/0071 273/371
4,611,812 A * 9/1986 Morrison ..... A63B 63/08 473/485
5,120,053 A * 6/1992 Head ..... A63B 67/002 273/402
5,242,164 A 9/1993 Nicoll
5,522,598 A * 6/1996 Loyd ..... A63B 63/08 273/402
5,632,490 A * 5/1997 Brown ..... A63F 7/048 273/350
5,749,581 A * 5/1998 Poisson ..... A63F 3/00047 273/298

(Continued)

FOREIGN PATENT DOCUMENTS

FR 2593405 A3 * 7/1987 ..... A63F 7/0612
GB 2320441 A * 6/1998 ..... A63F 3/00047

(Continued)

*Primary Examiner* — Kiley S Stoner

(57) ABSTRACT

A simulated basketball game system for playing a game simulating a basketball game includes a plurality of closed loops each having a vertically oriented channel extending therethrough. The plurality of closed loops are radially arranged around a vertically oriented rod and positioned adjacent to a top end of the vertically oriented rod.

19 Claims, 8 Drawing Sheets

(56) References Cited

U.S. PATENT DOCUMENTS

| | | | | | |
|---|---|---|---|---|---|
| 5,788,242 | A * | 8/1998 | Rudell | A63B 69/0071 | 273/357 |
| 5,842,699 | A * | 12/1998 | Mirando | A63B 69/0071 | 473/480 |
| 6,142,890 | A * | 11/2000 | Craig | A63B 63/08 | 473/433 |
| 7,293,771 | B1 * | 11/2007 | Montgomery | A63F 3/00047 | 273/277 |
| 7,566,059 | B2 | 7/2009 | Bianco | | |
| 8,651,492 | B1 * | 2/2014 | Cappuccio | A63B 71/0036 | 273/398 |
| D793,498 | S * | 8/2017 | Manus | D21/699 | |
| D872,815 | S * | 1/2020 | Parsons | D21/699 | |
| D886,926 | S * | 6/2020 | Scott | D21/698 | |
| 2009/0115135 | A1 * | 5/2009 | Bianco | A63F 7/0612 | 273/317.3 |
| 2010/0113190 | A1 * | 5/2010 | Vysosias | A63B 63/08 | 473/481 |
| 2011/0237362 | A1 * | 9/2011 | Yach | A63F 9/02 | 473/481 |
| 2012/0202623 | A1 | 8/2012 | Bowden | | |
| 2016/0082333 | A1 * | 3/2016 | Tappin | A63F 7/0612 | 273/400 |
| 2019/0166986 | A1 * | 6/2019 | Tsai | A47B 3/0912 | |
| 2020/0070042 | A1 * | 3/2020 | Peel | A63F 9/0204 | |
| 2020/0155923 | A1 * | 5/2020 | Brown | A63F 3/00047 | |
| 2024/0216789 | A1 * | 7/2024 | Schmider | A63F 7/0612 | |

FOREIGN PATENT DOCUMENTS

| | | | | |
|---|---|---|---|---|
| KR | 20080005724 U | * | 11/2008 | G07F 17/3202 |
| KR | 20100002929 U | * | 3/2010 | A63F 7/0612 |
| KR | 2020072814 A | * | 6/2020 | |
| KR | 20200072814 A | * | 6/2020 | A63F 7/24 |
| KR | 20220008358 A | * | 1/2022 | A63F 3/00047 |
| WO | WO9711761 | | 3/1997 | |

* cited by examiner

SIMULATED BASKETBALL GAME SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to game systems and more particularly pertains to a new game system for playing a game simulating a basketball game.

(2) Description of Related Art Including Information Disclosed Under 37 CFR 1.97 and 1.98

The prior art relates to game systems which use a structure with a goal in the shape of a hoop, cup, hole, or the like for launching a projectile in an attempt to direct the projectile into the goal. The projectile in the prior art game systems is typically a spherical ball meant to simulate a basketball. In some cases, the projectile is launched by throwing it by the hand. In other cases, it is launched by a component of the game system.

BRIEF SUMMARY OF THE INVENTION

An embodiment of the disclosure meets the needs presented above by generally comprising a base member. A rod is coupled to and extends upwardly from the base member. The rod is elongated. A plurality of closed loops is coupled to a distal end of the rod with respect to the base member. Each closed loop of the plurality of closed loops has a vertically orientated channel extending therethrough, and the plurality of closed loops being arranged radially around the rod.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
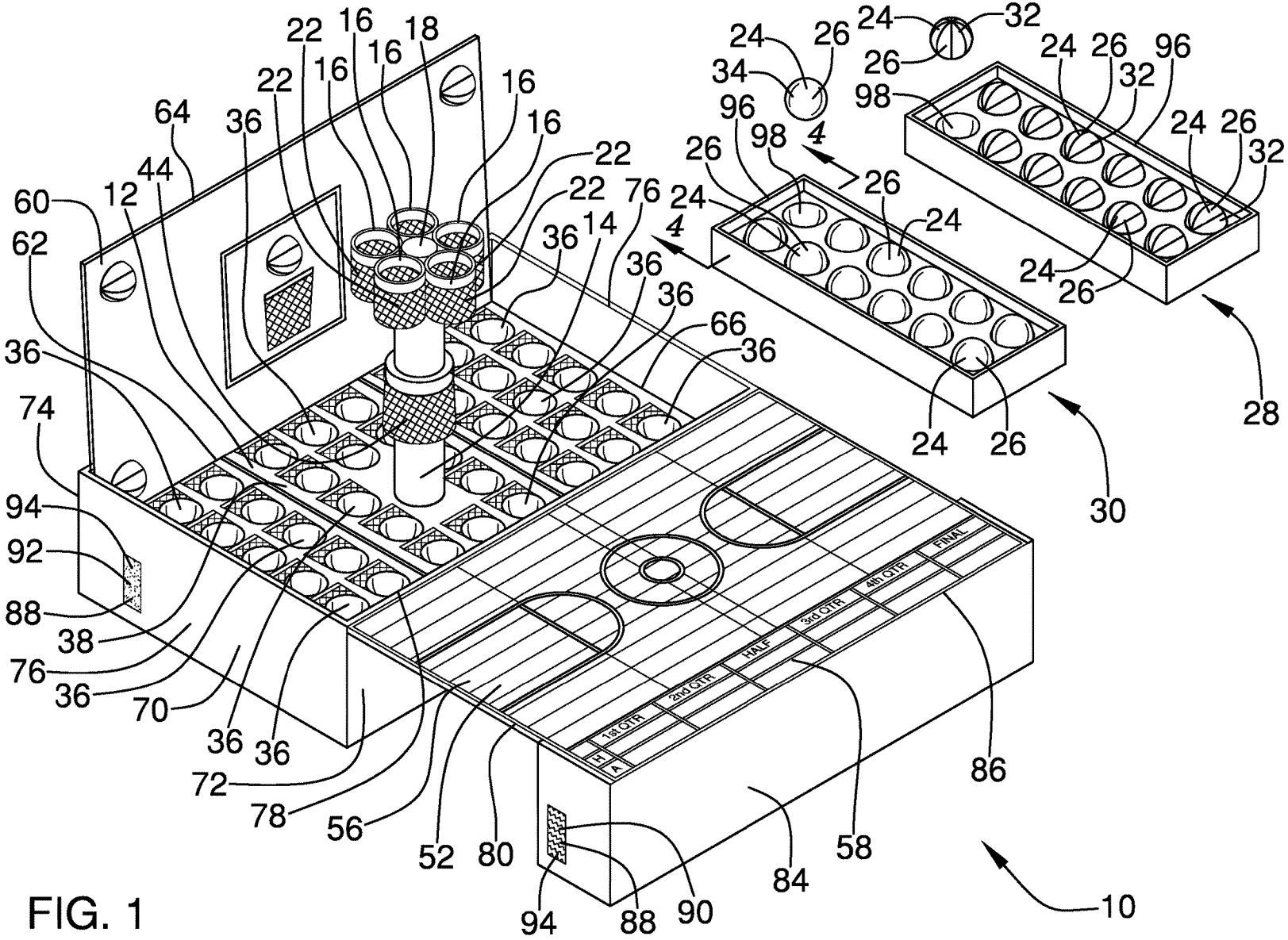
FIG. 1 is a top front side perspective view of a simulated basketball game system according to an embodiment of the disclosure.
Figure 2:
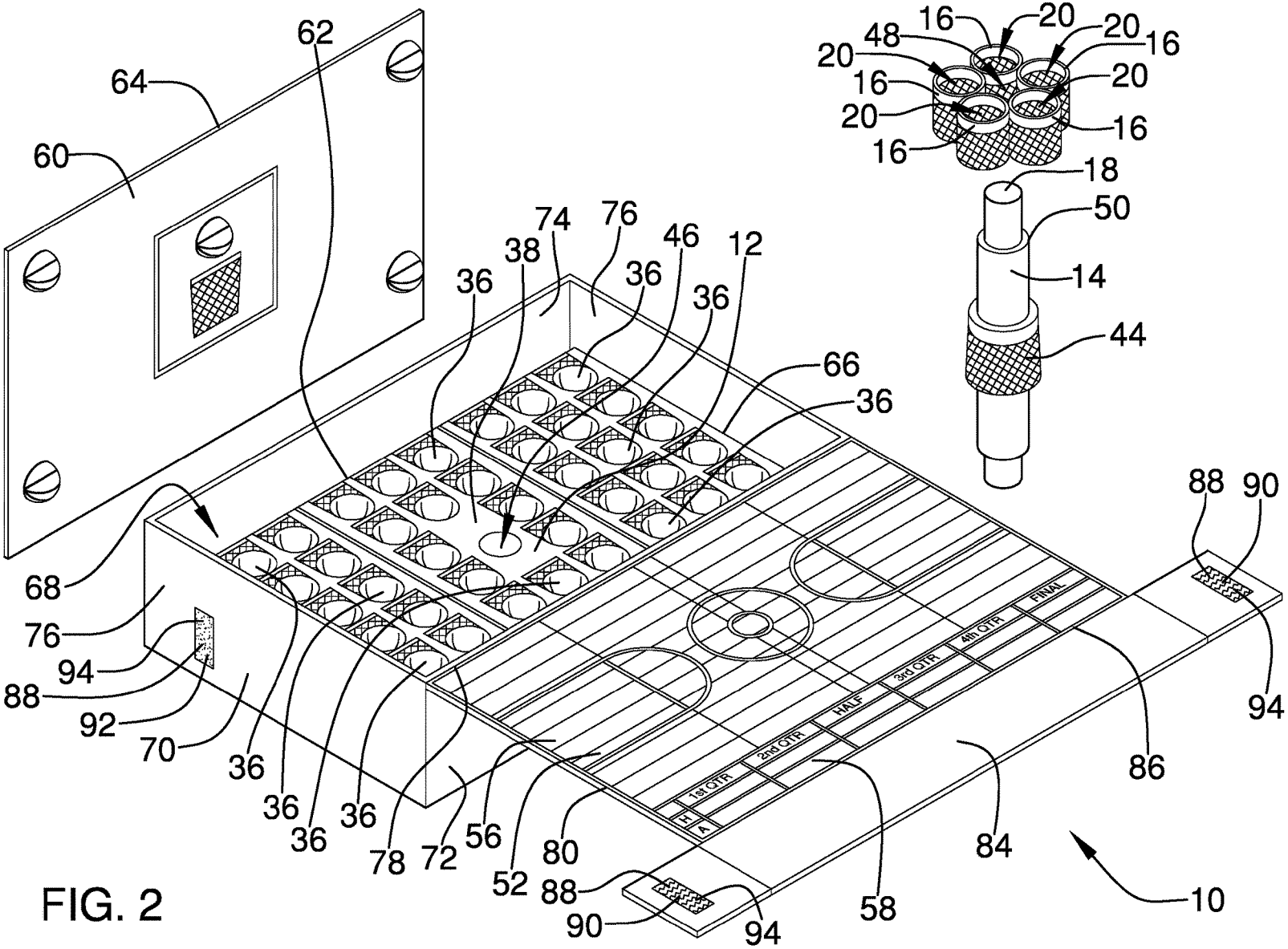
FIG. 2 is an exploded perspective view of an embodiment of the disclosure.
Figure 3:
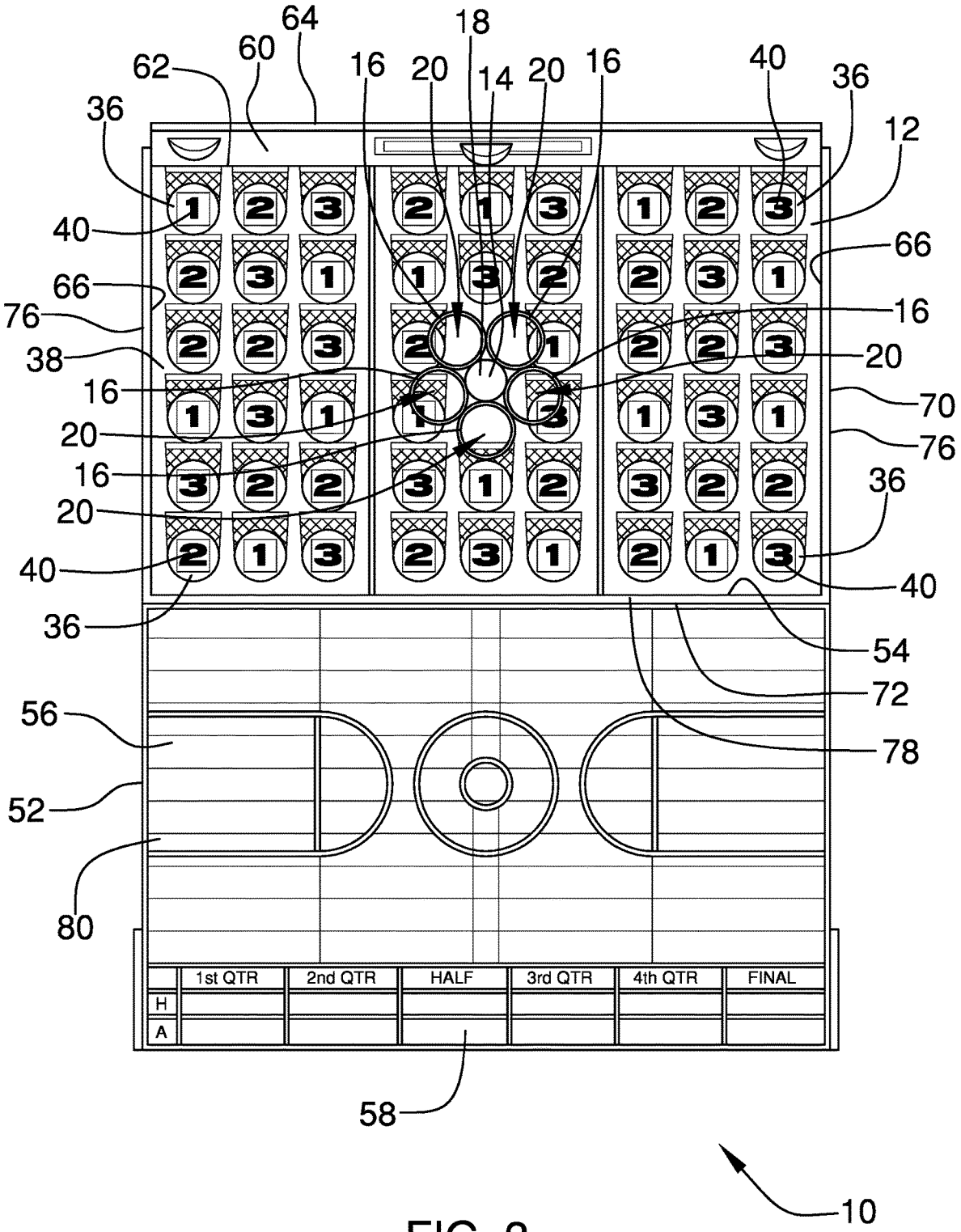
FIG. 3 is a top view of an embodiment of the disclosure.
Figure 4:
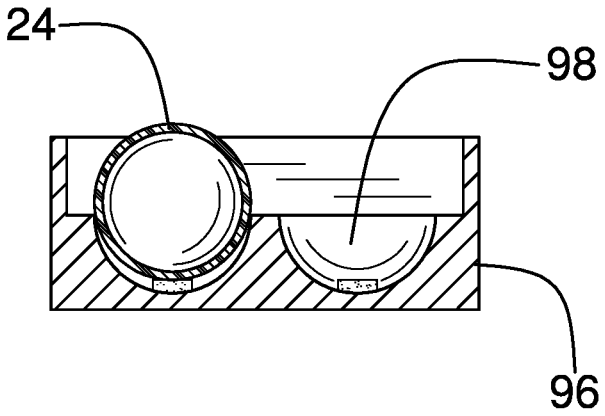
FIG. 4 is a cross-sectional view of an embodiment of the disclosure from the arrows 4-4 in FIG. 1.
Figure 5:
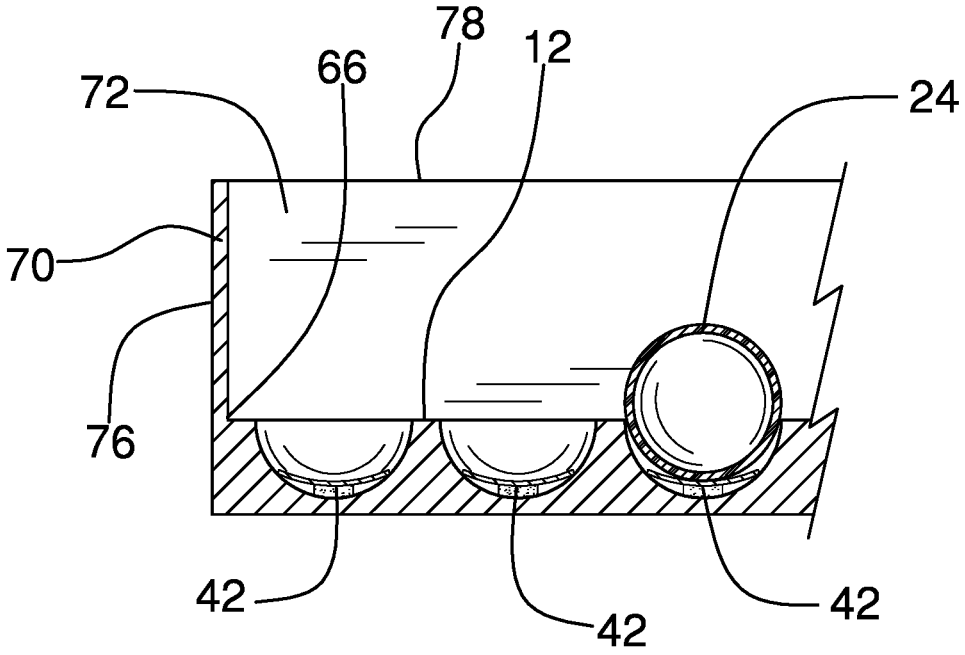
FIG. 5 is a cross-sectional view of an embodiment of the disclosure from the arrows 5-5 in FIG. 6.
Figure 6:
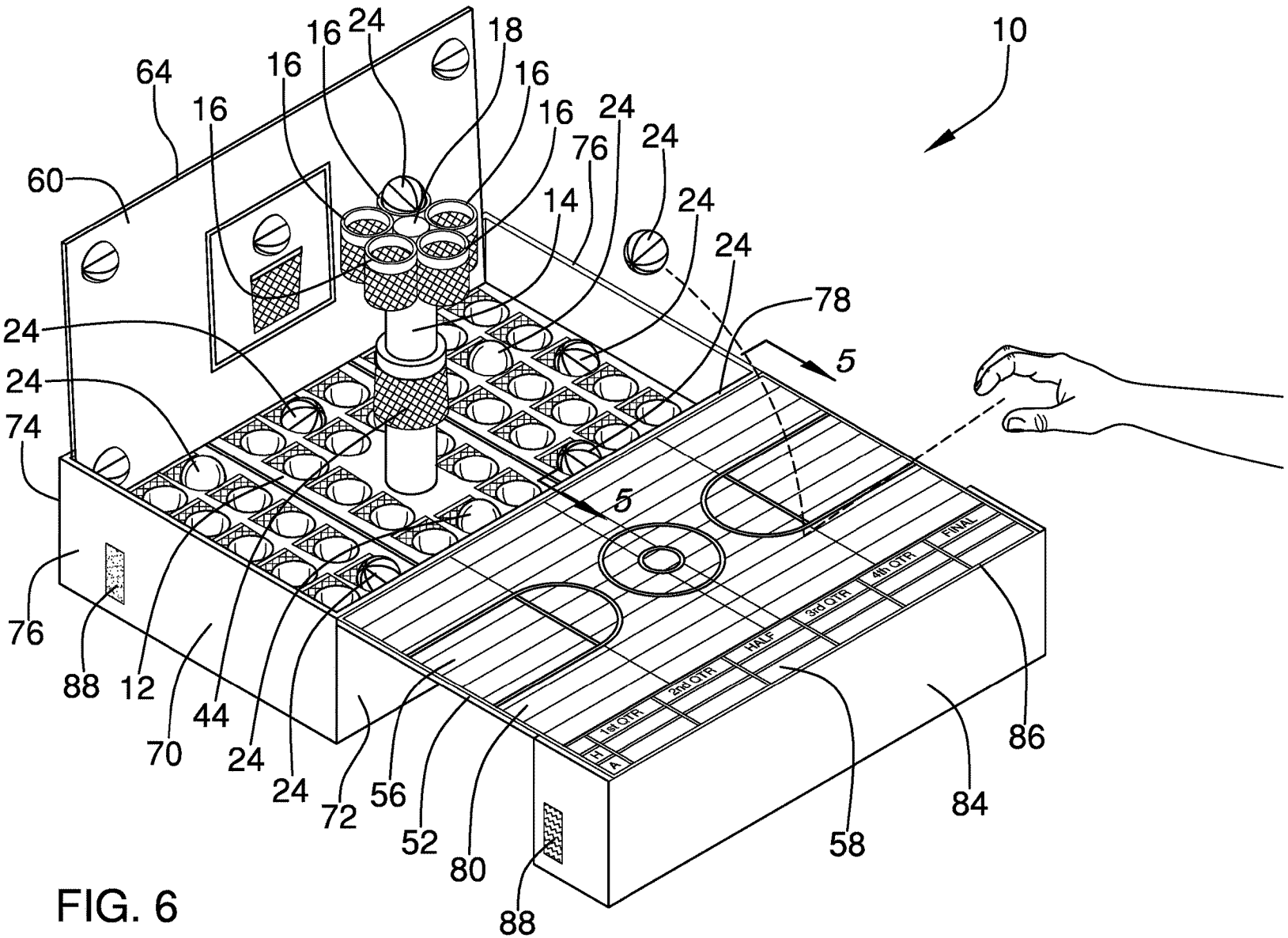
FIG. 6 is an in-use view of an embodiment of the disclosure.
Figure 7:
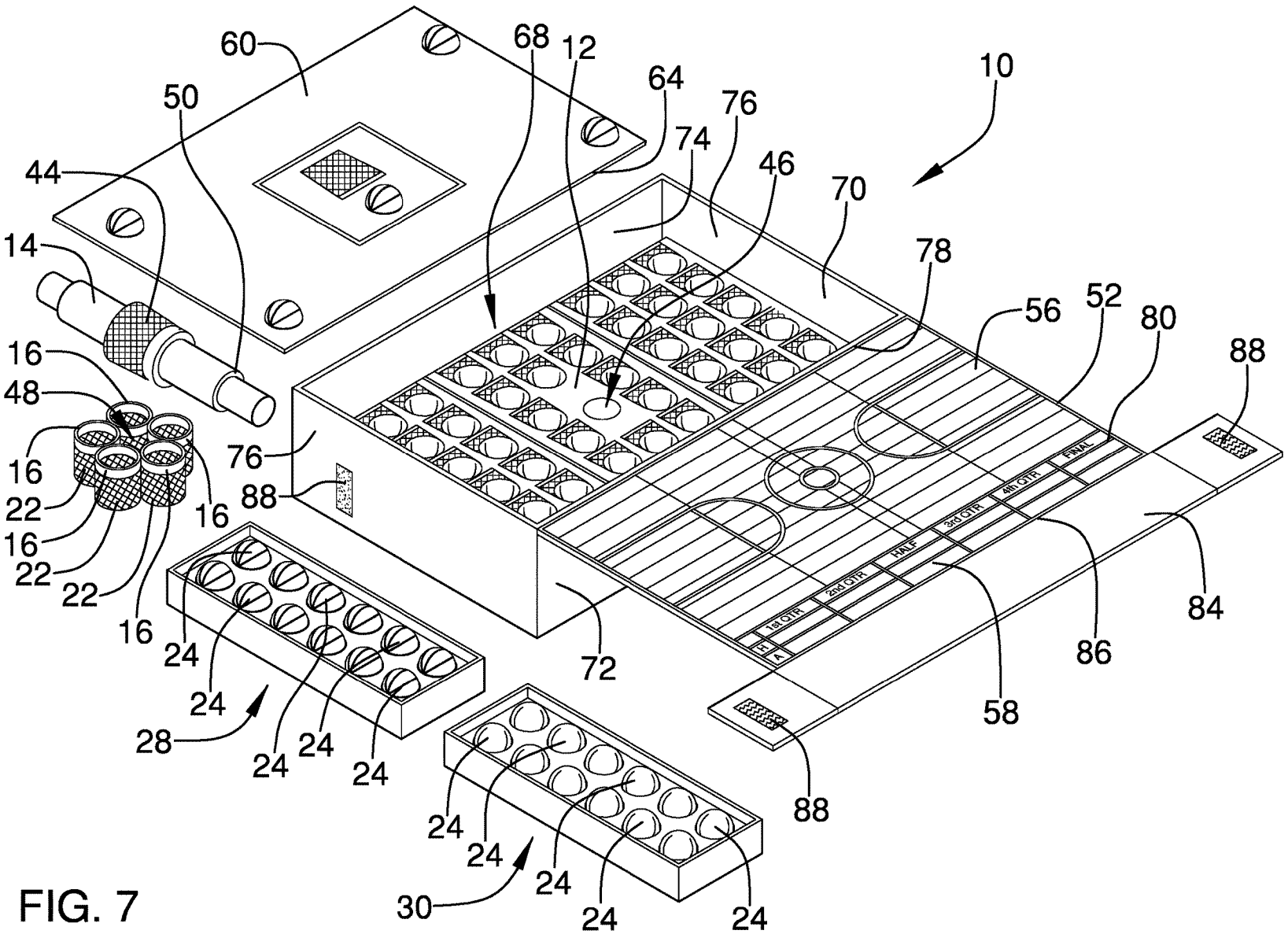
FIG. 7 is an exploded view of an embodiment of the disclosure.
Figure 8:
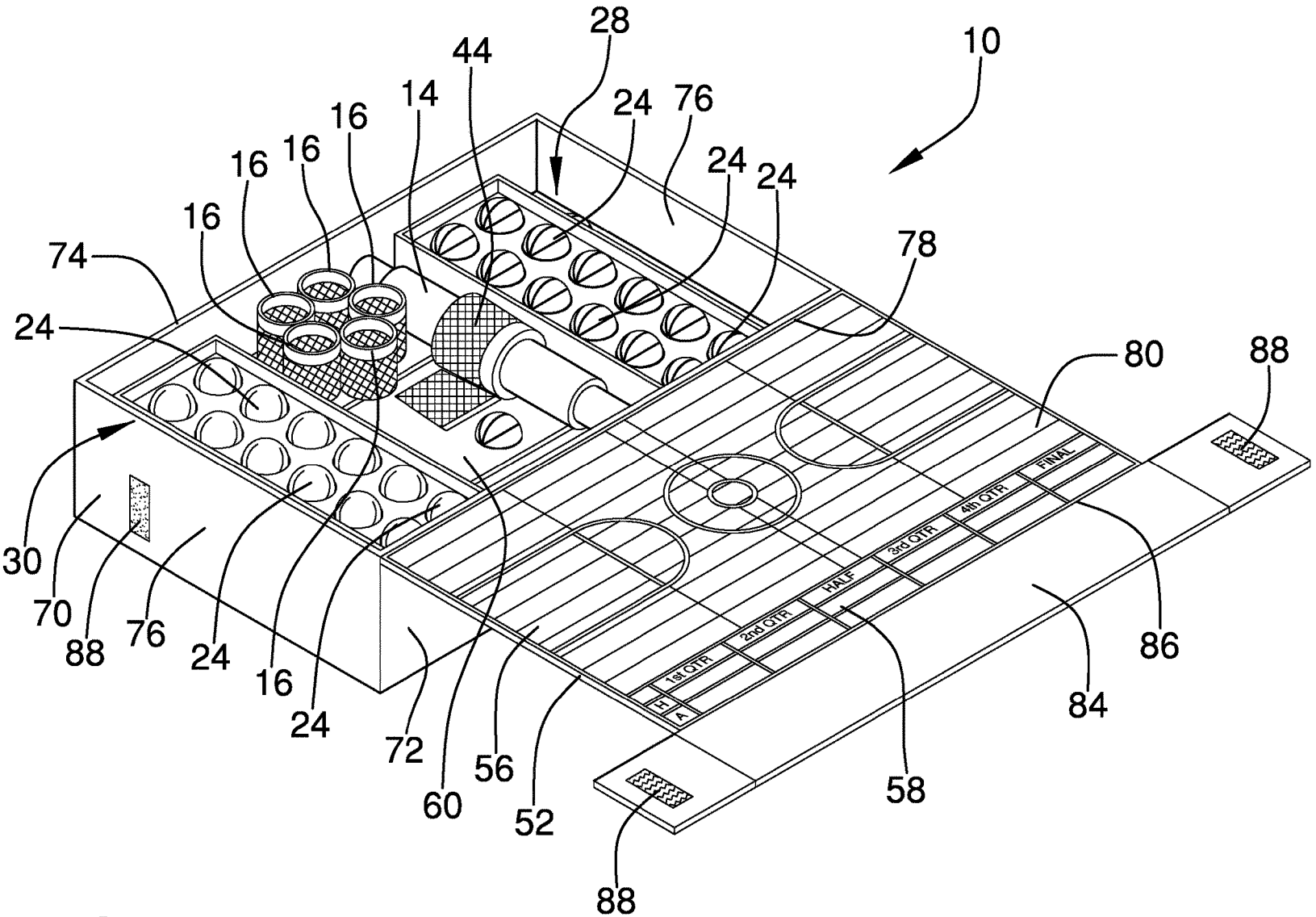
FIG. 8 is a top front side perspective view of an embodiment of the disclosure in a partially stored configuration.
Figure 9:
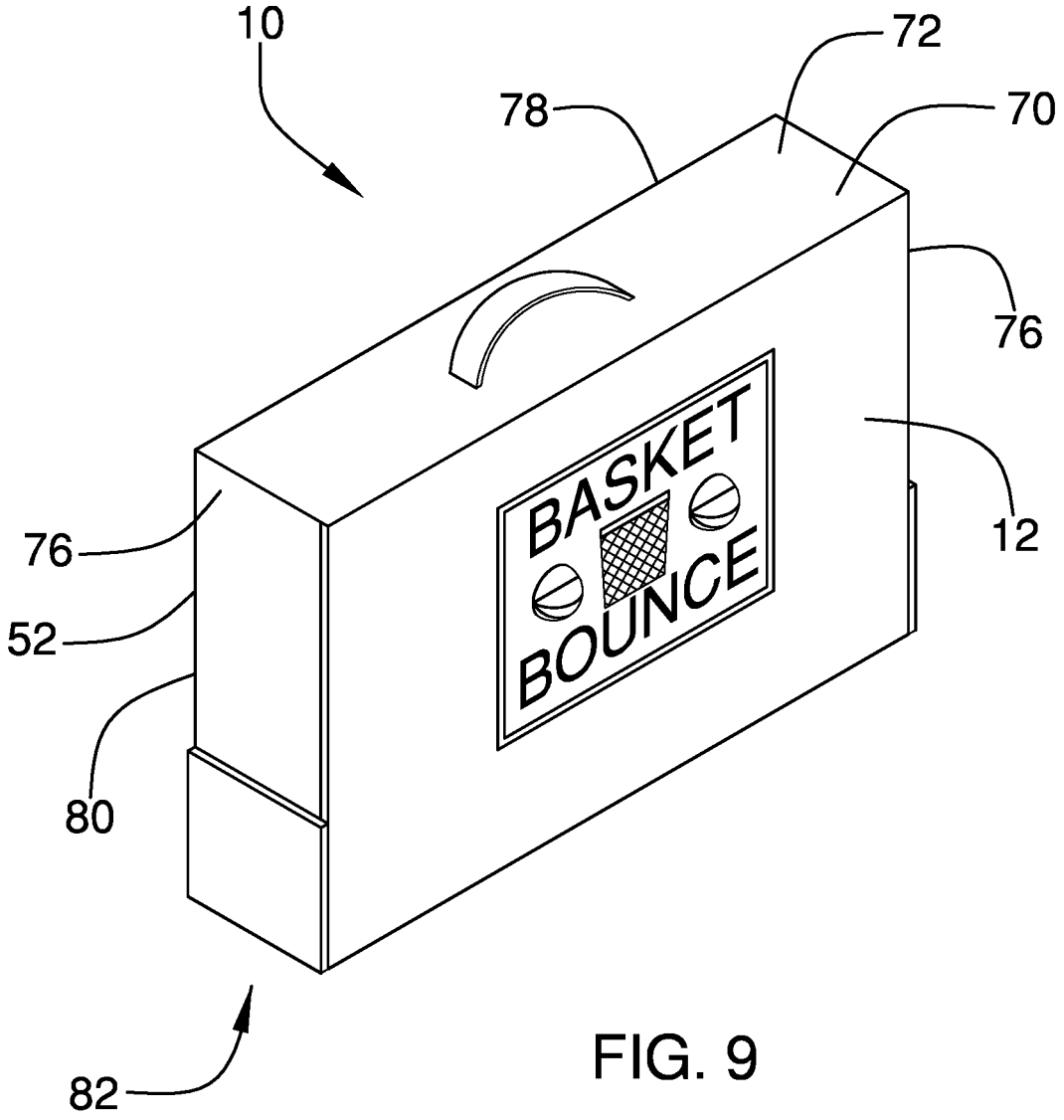
FIG. 9 is a perspective view of an embodiment of the disclosure in a stored configuration.

With reference now to the drawings, and in particular to FIGS. 1 through 9 thereof, a new game system embodying the principles and concepts of an embodiment of the disclosure and generally designated by the reference numeral 10 will be described.

As best illustrated in FIGS. 1 through 9, the simulated basketball game system generally comprises a base member 12. A rod 14 is coupled to and extends upwardly from the base member 12. The rod 14 is elongated and may be centrally located on the base member 12. A plurality of closed loops 16 is coupled to a distal end 18 of the rod 14 with respect to the base member 12. Each of the plurality of closed loops 16 has a vertically orientated channel 20 extending therethrough. The plurality of closed loops 16 is arranged radially around the rod 14, and each closed loop 16 abuts adjacent closed loops 16. Each of the plurality of closed loops 16 may be coupled together and lying in a same plane relative to each other. Each of a plurality of tubular nets 22 may be attached to and extend downwardly from one of the closed loops 16. Each of the tubular nets 22 will typically be flexible. The channel 20 of each of the plurality of closed loops 16 extends vertically through an associated tubular net 22.

A plurality of balls 24 may be provided for use in a game utilizing the simulated basketball game system 10. The vertically oriented channel 20 of each of the closed loops 16 has a size configured to allow passage of each ball 24 therethrough. Each of the balls 24, which are typically comprised of a plastic or elastomeric material to resemble a conventional but diminutive basketball, may have a spherical shape 26 and may include a first set 28 of balls 24 and a second set 30 of balls 24. A basketball indicia 32 is coupled to each ball 24 of said first set 28 of balls 24 which simulates an appearance of a basketball and visually differentiates each ball 24 of the first set 28 of balls 24 from each ball 24 of the second set 30 of balls 24. "Indicia" as used in the specification and the claims is used to refer to both a singular and a plurality of markings or indicating features. Each ball 24 of the second set 30 of balls 24 is photoluminescent. Each ball 24 of at least one of the first 28 and second 30 sets of balls 24 may also comprise alternative indicia to the basketball indicia 32 for visually differentiating the first 28 and second 30 sets of balls 24. The alternative indicia may include letters, numbers, graphical images, geometric shapes, colors, logos, or the like.

The base member 12 has a plurality of recesses 36 extending through a top surface 38 of the base member 12, each of which is shaped for receiving one of the balls 24. Each of the plurality of recesses 36 is convexly arcuate. Each of a plurality of score indicia 40 is positioned in one of the plurality of recesses 36 for indicating a score value for an associated one of the recesses 36. The score indicia 40 may comprise numbers, letters, graphical images, geometric shapes, colors, or the like. Each recess 36 may also have one of a plurality of spacers 42 positioned therein which is coupled to the base member 12. When a ball 24 lands in one of the recesses 36, an associated spacer 42 for the recess 36 positions the ball 24 to protrude out of the recess 36 for easy removal of the ball 24.

A deflector 44 is also coupled to and extends outwardly away from the rod 14. The deflector 44 is positioned below the closed loops 16 and is shaped to deflect the balls 24 away from the rod 14 when the balls 24 fall through one of the closed loops 16. The rod 14 is detachable from the base member 12, and the top surface 38 has a slot 46 extending therein for receiving the rod 14. The plurality of closed loops 16 is collectively detachable from the rod 14. The closed loops 16 form an interior perimeter 48 that is abuttably positionable on a shoulder 50 of the rod 14 formed by an increase in the rod's 14 diameter.

A rebound panel 52 is positioned adjacent to and extending forwardly from a front side 54 of the base member 12. The rebound panel 52 has a rebounding surface 56 which faces upwardly and is oriented horizontally. A plane of the rebounding surface 56 is spaced vertically above a plane of the top surface 38 of the base member 12. In some embodiments, a graphical image depicting a basketball court is positioned on the rebounding surface 56. A score table 58 may also be positioned on the rebounding surface 56 which includes fields to write scores obtained during the play of a game using the simulated basketball game system 10. In embodiments with a score table 58 positioned on the rebounding surface 56, the rebound panel 52 comprises a material for writing on such as a chalkboard, a dry erase board, or the like.

A backboard 60 is coupled to and extending upwardly from the base member 12 for preventing balls 24 from passing behind the base member 12. The backboard 60 is positioned adjacent to a back side 62 of the base member 12. A horizontal plane of a top edge 64 of the backboard 60 is vertically spaced above a horizontal plane of the distal end 18 of the rod 14. The backboard 60 extends between a pair of lateral sides 66 of the base member 12. The backboard 60 is detachable from the base member 12, and the base member 12 has a notch 68 extending into the top surface 38 for receiving the backboard 60 therein.

A perimeter wall 70 is attached to and extending upwardly from the base member 12. The perimeter wall 70 has a front wall 72, a back wall 74, and a pair of lateral side walls 76. The rebound panel 52 is pivotally coupled to an upper edge 78 of the front wall 72 and defines a cover 80 for pivoting and covering the base member 12. The cover 80 is positionable in a closed position 82 wherein the cover 80 covers the base member 12, and the cover 80 is securable in the closed position 82.

A support 84 is coupled to a distal edge 86 of the rebound panel 52 relative to the front wall 72. The support 84 extends downwardly from the rebound panel 52 when the rebound surface is upwardly facing to engage a surface and retain the rebound panel 52 in a horizontal orientation. At least one fastening member 88 is coupled to the support 84 and the perimeter wall 70 for securing the rebound panel 52 in the closed position 82. The at least one fastening member 88 comprises a first mating element 90 and a second mating element 92, the first mating element 90 being releasably attachable to the second mating element 92. The first mating element 90 is coupled to the support 84, and the second mating element 92 is coupled to the perimeter wall 70. The support 84 is pivotal with respect to the rebound panel 52 and is extended downwardly from the rebound panel 52 when the rebound surface is downwardly facing such that the first 90 and second 92 mating elements are engageable with each other. The at least one fastening member 88 comprises a hook-and-loop fastener 94, but may comprise a latch, buckle, or the like.

A pair of trays 96 may also be included which each have a plurality of depressions 98 for holding one of the sets of balls 24. In one embodiment, the trays 96 holding the sets of balls 24, the rod 14, the plurality of closed loops 16, and the backboard 60 are positionable between the base member 12 and the cover 80 when the cover 80 is in the closed position 82 for convenient storage and portability.

In use, a first player and a second player play a game using the basketball simulation game system 10. One of the first 28 and second 30 sets of balls 24 is selected for playing the game. The second set 30 of balls 24 may be chosen to facilitate playing the game in a darkened environment, because each ball 24 of the second set 30 of balls 24 is photoluminescent. Photoluminescent materials may also be incorporated into at least one of the base member 12, the rod 14, the plurality of closed loops 16, the plurality of tubular nets 22, the deflector 44, the backboard 60, and the perimeter wall 70 to increase visibility in the darkened environment.

In a round of play, the first player consecutively throws each ball 24 of the selected set of balls 24 toward the rebounding surface 56 in an attempt to land each ball 24 in one of the closed loops 16. Points are awarded to the first player when one of the balls 24 passes through one of the closed loops 16. Points are also awarded to the one player when the ball 24 lands in one of the recesses 36 in the base member 12, whether or not the ball 24 passes through one of the closed loops 16. The thrown balls 24 are collected, and the second player also throws each ball 24 of the selected set of balls 24 in like manner to the first player. In one variation of the game, two points are awarded for passing one of the balls 24 through one of the closed loops 16, and the value of points awarded for landing one of the balls 24 in one of the recesses 36 is equal to the score indicated by the score indicia 40 associated with the recess 36 in which the ball 24 landed. In embodiments with a score table 58, the score for each player may be recorded on the score table 58. The first and second players repeat these steps for three more rounds of play. A total score for each player is calculated by summing the scores for all rounds of play for each player. The player with the greater total score wins the game.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A simulated basketball game system comprising:

a base member;

a rod being coupled to and extending upwardly from the base member, the rod being elongated; and a plurality of closed loops being coupled to a distal end of the rod with respect to the base member, each closed loop of the plurality of closed loops having a vertically orientated channel extending therethrough, the plurality of closed loops being arranged radially around the rod; and a backboard being coupled to and extending upwardly from the base member, the backboard being positioned adjacent to a back side of the base member.

2. The system of claim 1, wherein each closed loop abuts adjacent ones of the closed loops.

3. The system of claim 2, wherein each of the plurality of closed loops being coupled together and lying in a same plane relative to each other.

4. The system of claim 1, further comprising a plurality of tubular nets, each of the closed loops having one of the tubular nets being attached thereto and extending downwardly therefrom, each of the tubular nets being flexible, the channel of each of the plurality of closed loops extending vertically through the tubular net thereof.

5. A simulated basketball game system comprising:

a base member;

a rod being coupled to and extending upwardly from the base member, the rod being elongated;

a plurality of closed loops being coupled to a distal end of the rod with respect to the base member, each closed loop of the plurality of closed loops having a vertically orientated channel extending therethrough, the plurality of closed loops being arranged radially around the rod;

the base member having a plurality of recesses extending through a top surface of the base member; and a plurality of score indicia, each recess having one of the indicia positioned therein for indicating a score value for an associated recess of the plurality of recesses.

6. The system of claim 1, further comprising a deflector being coupled to the rod and extending outwardly away from the rod, the deflector being positioned below the closed loops.

7. The system of claim 5, wherein the rod is detachable from the base member, the top surface having a slot extending therein for receiving the rod, the plurality of closed loops being collectively detachable from the rod.

8. A simulated basketball game system comprising:

a base member;

a rod being coupled to and extending upwardly from the base member, the rod being elongated;

a plurality of closed loops being coupled to a distal end of the rod with respect to the base member, each closed loop of the plurality of closed loops having a vertically orientated channel extending therethrough, the plurality of closed loops being arranged radially around the rod; and a rebound panel being positioned adjacent to and extending forwardly from a front side of the base member, the rebound panel having a rebounding surface facing upwardly, the rebounding surface being oriented horizontally.

9. The system of claim 8, wherein a plane of the rebounding surface is spaced vertically above a plane of the top surface of the base member.

10. The system of claim 1, wherein a horizontal plane of a top edge of the backboard is vertically spaced above a horizontal plane of the distal end of the rod.

11. The system of claim 1, wherein the backboard extends between a pair of lateral sides of the base member.

12. The system of claim 1, wherein the backboard is detachable from the base member, the base member having a notch extending into the top surface for receiving the backboard therein.

13. The system of claim 1, further comprising a plurality of balls, the vertically oriented channel of each closed loop having a size configured to allow passage of each ball therethrough.

14. The system of claim 13, wherein each ball has a spherical shape.

15. The system of claim 13, further comprising:

the plurality of balls including a first set of balls and a second set of balls, said second set of balls being photoluminescent;

a basketball indicia being coupled to each ball of said first set of balls, said basketball indicia simulating an appearance of a basketball, said basketball indicia visually differentiating each ball of said first set of balls from each ball of said second set of balls.

16. The system of claim 8, further comprising:

a perimeter wall being attached to and extending upwardly from the base member, the perimeter wall having a front wall, a back wall, and a pair of lateral side walls; and the rebound panel being pivotally coupled to an upper edge of the front wall, the rebound panel defining a cover for pivoting and covering the base member, the cover being positionable in a closed position wherein the cover covers the base member, the cover being securable in the closed position.

17. The system of claim 16, further comprising a support being coupled to a distal edge of the rebound panel relative to the front wall, the support extending downwardly from the rebound panel when the rebound surface is upwardly facing to engage a surface and retain the rebound panel in a horizontal orientation.

18. The system of claim 17, further comprising at least one fastening member being coupled to the support and the perimeter wall for securing the rebound panel in the closed position, the at least one fastening member comprising a first mating element and a second mating element, the first mating element being releasably attachable to the second mating element, the first mating element being coupled to the support, the second mating element being coupled to the perimeter wall, the support being pivotal with respect to the rebound panel and being extended downwardly from the rebound panel when the rebound surface is downwardly facing such that the first and second mating elements are engageable with each other.

19. The simulated basketball game system of claim 1, further comprising:

a plurality of balls each having a spherical shape, the plurality of balls including a first set of balls and a second set of balls, said second set of balls being photoluminescent;

a basketball indica being coupled to each ball of said first set of balls, said basketball indicia simulating an appearance of a basketball, said basketball indicia visually differentiating each ball of said first set of balls from each ball of said second set of balls;

said base member having a plurality of recesses extending through a top surface of the base member, each of the plurality of recesses being shaped for receiving one of the plurality of balls, each of the plurality of recesses being convexly arcuate;

a plurality of score indicia, each recess having one of the indicia positioned therein for indicating a score value for an associated recess of the plurality of recesses;

the rod being centrally located on the base member;

each vertically oriented channel having a size configured to allow passage of each ball therethrough, each closed loop abutting adjacent ones of the closed loops, each of the plurality of closed loops being coupled together and lying in a same plane relative to each other;

a plurality of tubular nets, each of the closed loops having one of the tubular nets being attached thereto and extending downwardly therefrom, each of the tubular nets being flexible, the channel of each of the plurality of closed loops extending vertically through the tubular net thereof;

a deflector being coupled to the rod and extending outwardly away from the rod, the deflector being positioned below the closed loops and deflecting the balls away from the rod when the balls fall through one of the closed loops;

the rod being detachable from the base member, the top surface having a slot extending therein for receiving the rod, the plurality of closed loops being collectively detachable from the rod;

a rebound panel being positioned adjacent to and extending forwardly from a front side of the base member, the rebound panel having a rebounding surface facing upwardly, the rebounding surface being oriented horizontally, a plane of the rebounding surface being spaced vertically above a plane of the top surface of the base member;

a horizontal plane of a top edge of the backboard being vertically spaced above a horizontal plane of the distal end of the rod, the backboard extending between a pair of lateral sides of the base member, the backboard being detachable from the base member, the base member having a notch extending into the top surface for receiving the backboard therein;

a perimeter wall being attached to and extending upwardly from the base member, the perimeter wall having a front wall, a back wall, and a pair of lateral side walls;

the rebound panel being pivotally coupled to an upper edge of the front wall, the rebound panel defining a cover for pivoting and covering the base member, the cover being positionable in a closed position wherein the cover covers the base member, the cover being securable in the closed position;

a support being coupled to a distal edge of the rebound panel relative to the front wall, the support extending downwardly from the rebound panel when the rebound surface is upwardly facing to engage a surface and retain the rebound panel in a horizontal orientation; and at least one fastening member being coupled to the support and the perimeter wall for securing the rebound panel in the closed position, the at least one fastening member comprising a first mating element and a second mating element, the first mating element being releasably attachable to the second mating element, the first mating element being coupled to the support, the second mating element being coupled to the perimeter wall, the support being pivotal with respect to the rebound panel and being extended downwardly from the rebound panel when the rebound surface is downwardly facing such that the first and second mating elements are engageable with each other, the at least one fastening member comprising a hook-and-loop fastener.

* * * * *